United States Patent [19]

Campagnuolo et al.

[11] 4,362,106

[45] Dec. 7, 1982

[54] FLOW DEFLECTOR FOR AIR DRIVEN POWER SUPPLY

[75] Inventors: Carl J. Campagnuolo, Potomac; Henry C. Lee, Annapolis, both of Md.

[73] Assignee: The United States of America as represented by the Secretary of the Army, Washington, D.C.

[21] Appl. No.: 142,548

[22] Filed: Apr. 21, 1980

[51] Int. Cl.[3] ..... F42C 11/00

[52] U.S. Cl. ..... 102/207

[58] Field of Search ..... 102/208, 207

[56] References Cited

U.S. PATENT DOCUMENTS

| | | | |
|---|---|---|---|
| 2,701,526 | 2/1955 | Rotkin | 102/208 |
| 2,895,063 | 7/1959 | Morris | 102/207 |
| 3,772,541 | 11/1973 | Campagnuolo et al. | 102/207 |
| 3,792,664 | 2/1974 | Campagnuolo | 102/207 |
| 3,971,321 | 7/1976 | Blodgett et al. | 102/207 |

*Primary Examiner*—Charles T. Jordan

*Attorney, Agent, or Firm*—Nathan Edelberg; Robert P. Gibson; Saul Elbaum

[57] ABSTRACT

An air deflector is provided for the air inlet means of a fuze ogive. The deflector comprises a stationary deflecting surface which is configured so as to substantially reduce the amount of air entering the ogive during high velocity flight, while not substantially reducing the air inflow during relatively low velocity flight.

9 Claims, 3 Drawing Figures

LOW VELOCITY FLOW

HIGH VELOCITY FLOW

FLOW DEFLECTOR FOR AIR DRIVEN POWER SUPPLY

RIGHTS OF THE GOVERNMENT

The invention described herein may be manufactured and used by or for the U.S. Government for governmental purposes without payment to us of any royalty thereon.

BACKGROUND OF THE INVENTION

It is known in the prior art to combine an air-driven power supply, such as a fluidic generator, with a projectile fuze. See, for example, U.S. Pat. Nos. 3,568,704; 3,772,541; 3,798,475; and, 3,971,321. When such a device is positioned in a projectile or missile to power the fuze electronics, ram air enters through an air inlet means and passes through a nozzle. Such air then proceeds to a resonating cavity. The acoustical vibration within the cavity causes a diaphragm to vibrate, such vibration driving a reed in a permanent magnetic field. It is evident that as the air velocity increases, the diaphragm displacement also increases until a condition is reached where the reeds bang against the pole pieces of the magnetic device. This banging causes noise in the electrical output and, more importantly, fatigues the reeds, which will eventually break causing a power loss in the electrical system.

Air driven generators, when used aboard a projectile or a missile, can experience velocities of 3,000 ft/sec or higher. These high flight velocities cause a large mass flow to enter the inlet of the power supply or generator. The large mass flows cause design fatigue, as noted above, lessen the structural integrity of the device, and increase development costs.

Prior attempts to regulate the flow of air into the fuze comprised mainly movable valves which responded to such variables as acceleration, air pressure, etc. Such devices met with limited success as they were highly sensitive, requiring delicate calibrations. Also, the high magnitude of mechanical forces experienced by the devices, as well as aerodynamic heating, resulted in many failures and a low degree of dependability.

It is an object of this invention to provide a simple device which will deflect some of the inlet flows to a fuze during high velocity flight. It is also an object to provide such a device which will not substantially affect the inflow of air to the fuze during the low velocity portion of its flight.

It is additionally an object of this invention to provide such a deflector which is simple, inexpensive, and has no moving parts requiring calibration.

It is additionally an object of the invention to provide such a device which has infinite shelf life, not experiencing any degree of deterioration in storage.

SUMMARY OF THE INVENTION

The deflector of the present invention is positioned at the air inlet of the fuze to divide the inlet flow into two portions. A portion of the flow enters the fuze directly while another portion of the flow engages the deflector. At very low operating pressures, the flow from the deflector has very little influence on the flow proceeding into the inlet of the fuze. This enables the fluidic generator of the fuze to operate at very low pressures. As the inlet velocity or pressure increases, the momentum of the flow across the deflector also increases. This increase in momentum causes a portion of the flow directly entering the inlet to deflect away from the inlet according to the well-known momentum exchange principle of fluid jets. Though flow deflection takes place, some of the flow nevertheless enters into the inlet of the fuze causing the generator to remain in operation. The reduced mass flow rate at high velocities enables the fluidic generator to operate without producing extraordinary stresses or rupturing of the mechanical parts thereof. Also, electrical noise from the signal output is reduced or eliminated.

DESCRIPTION OF A PREFERRED EMBODIMENT

Figure 1:
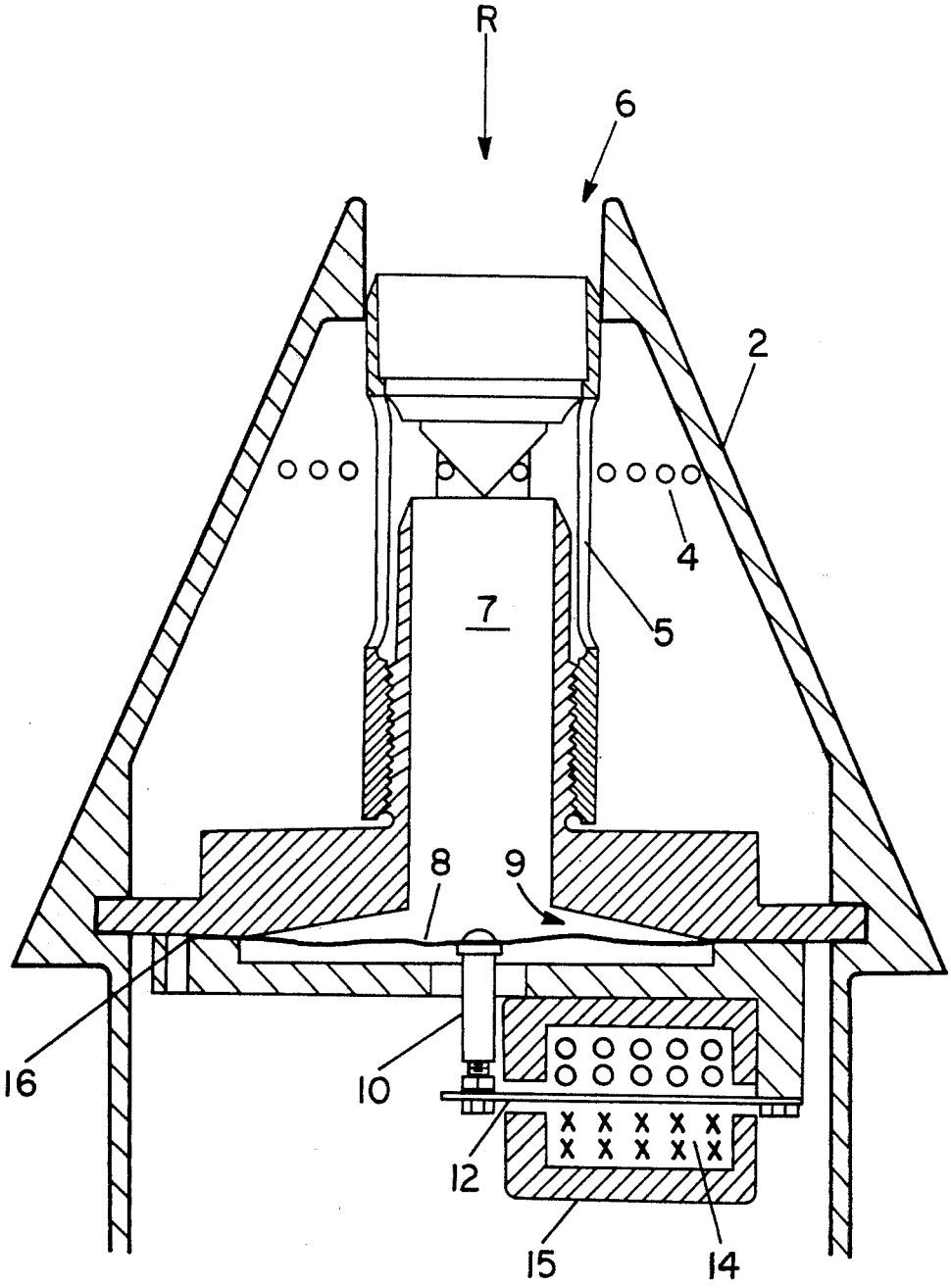
FIG. 1 illustrates an embodiment of a fuze ogive suitable for use with the deflector of the present invention.

FIG. 1 illustrates a somewhat conventional fuze ogive 2. Ventilating holes 4 and ventilating slots 5 are provided in the ogive. Air inlet 6 allows ram air, as designated by arror R, to enter the fuze and pass through air channel 7. The air enters resonating cavity 9, causing acoustical vibrations. Air entering resonating cavity 9 may be vented therefrom by means of vents provided about the periphery of the diaphragm 8, as indicated by reference numeral 16.

The acoustical vibrations cause oscillation of diaphragm 8, which is connected by means of post 10 to reed 12. Reed 12 is thereby oscillated within the magnetic field of the magnetic device 15, inducing a current in coil 14. This current is conventionally used to power the fuze electronics. As discussed above, when the mass flow or pressure of the ram air entering the fuze becomes excessive, the magnitude of the motion and the forces imposed on the diaphragm and the fluidic generator often becomes great enough to cause damage to the generator.

Figure 2:
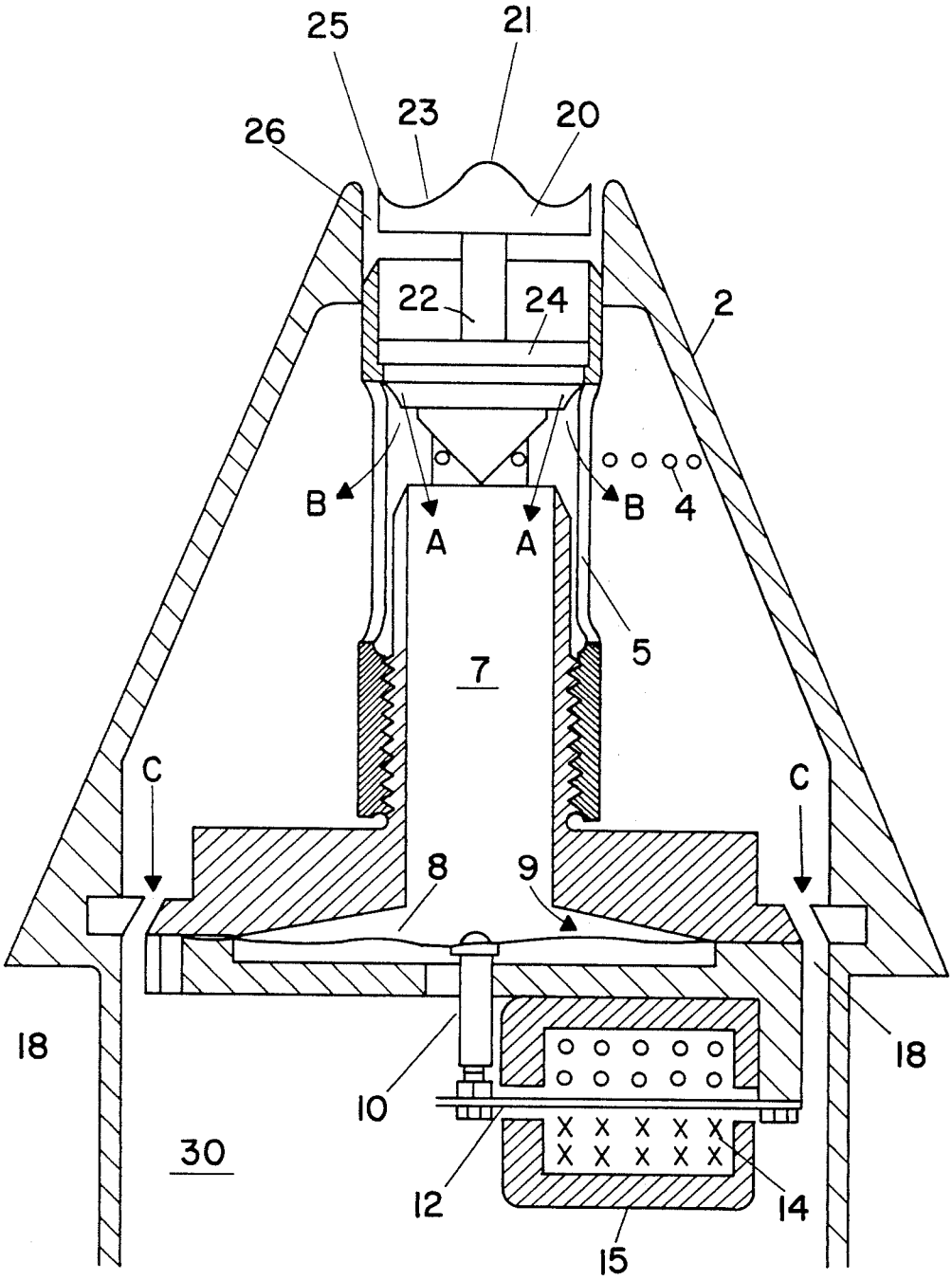
FIG. 2 illustrates the combination of a fuze ogive and the deflector of the present invention.

FIG. 2 illustrates the deflector of the present invention in combination with a fuze of the type shown in FIG. 1. Elements of the fuze structure as shown in FIG. 2 which correspond to those of FIG. 1 are correspondingly numbered.

The fuze of FIG. 2 additionally comprises deflector 20 mounted proximate the air inlet to the fuze. The deflector is held in a fixed position by means of post 22 and strut 24 secured to the fuze inlet means. In the configuration shown, the deflector comprises a central convex portion 21, and an annular concave, or trough-shaped portion 23. The outer-most edge of the deflector is turned upward as indicated at 25. An annular gap 26 comprises the inlet area for ram air flow to the fuze interior. The mode of operation of the deflector will be discussed subsequently with reference to FIG. 3.

In addition to the deflector, bleed-hole means 18 may be provided within the fuze ogive in order to equalize the pressure on opposite sides of diaphragm 8. This wil substantially reduce the likelihood of imposing excessive stresses on the diaphragm of the fluidic generator.

A portion of the air entering the fuze through gap 26 will pass through air channel means 7 to the cavity 9, as indicated by arrows A. The excess flow will pass through ventilating slots 5 as indicated by arrows B. Rather than merely being expelled through vent holes 4, as in the device of FIG. 1, a portion of flow B will pass through bleed-holes 18 as shown by arrow C. This will tend to increase the air pressure in the region 30 on the opposite side of the diaphragm 8, thereby reducing the likelihood that extreme, unbalanced forces will be imposed on the diaphragm. This further reduces the likelihood of damage to the fluidic generator.

Figure 3:
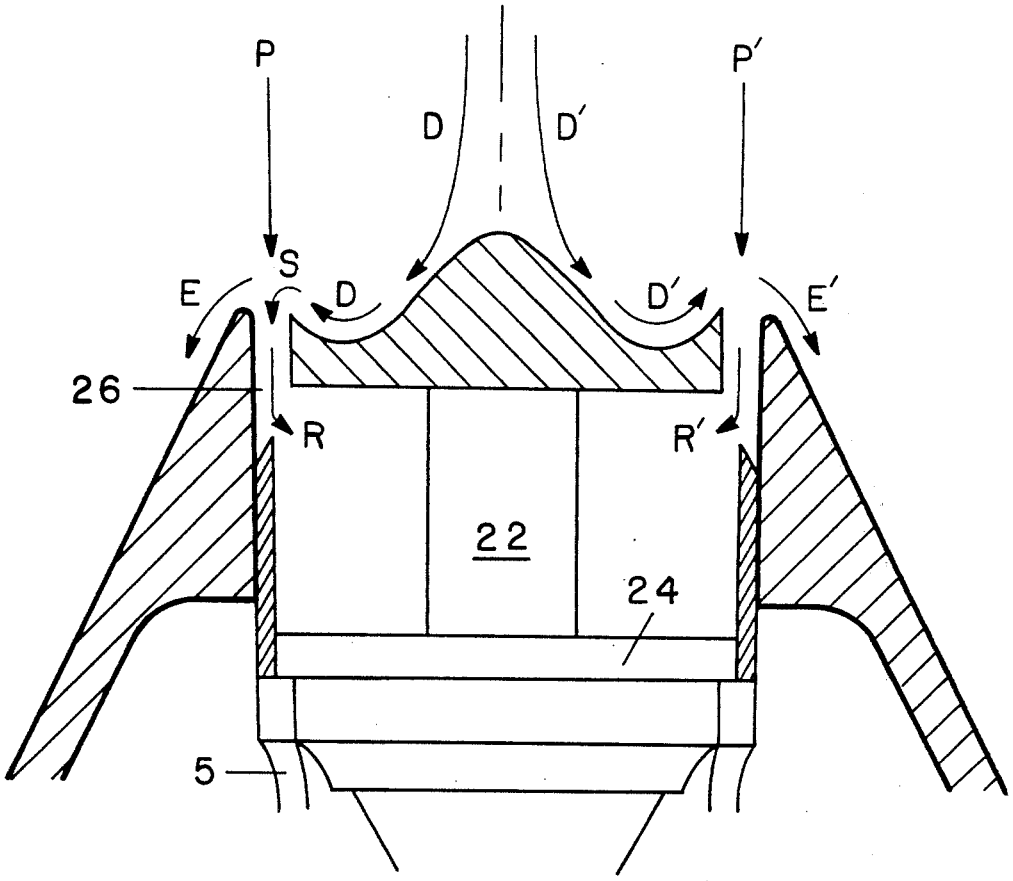
FIG. 3 is an enlarged view of the foremost portion of the fuze of FIG. 2, illustrating the mode of operation of the present invention.

FIG. 3 illustrates the manner in which the deflector of the present invention will operate to control the air flow into the fuze ogive. The left portion of FIG. 3 illustrates the mode of operation at relatively low supersonic air speeds. The right portion of FIG. 3 illustrates the mode of operation at relatively high supersonic velocities.

As indicated on the left-most portion of FIG. 3, at low velocity flow a primary portion P will enter the air inlet 26 directly. The portion of the flow contacting the deflector 20, as indicated by arrows D, will flow across the convex portion of the deflector, across the trough-shaped concave portion thereof, and will intersect with the path of flow P. Experimental results have shown that the flow D from the deflector has very little influence on the flow P at low velocities and pressures. Although the flow D will cause a portion of flow P to be diverted away from inlet 26, as shown by arrow E, the greatest portion of both of flows P and D will enter the inlet, as indicated by arrow R. A portion of flow D spills over the edge of the deflector into the inlet, as indicated by arrow S.

As the flow velocity and pressure increases, the mode of operation of the deflector changes substantially, as shown on the right-most portion of FIG. 3. Again, the primary flow P′ will directly enter the inlet 26 while the deflected portion of the flow D′ will pass across the deflector 20. Experimental results have shown that at increased velocities and pressures, the flows P′ and D′ interact in such manner that a substantially portion of the momentum of flow D′ is imparted to the flow P′, according to the well-known fluid jet momentum exchange principle. The result will be that a substantial portion of the flow P′ will be diverted away from inlet 26 as indicated by arrow E′. The relative portion of the flow entering inlet 26, as indicated by arrow R′, will be substantially reduced.

Tests conducted at air pressure simulating an altitude of 50,000 ft. and at velocities of 1300 ft/sec (mach 1.2) have resulted in approximately a 10 percent loss of air inflow to the fuze due to the presence of the deflector of the present invention. When the same tests were run at a velocity of 3,000 ft/sec approximately 70 percent of the air inflow was diverted from the fuze inlet. These tests indicate that the device successfully diverts a greater portion of the ram air flow from the fuze inlet at higher air speeds.

While the invention has been described with reference to the accompanying drawings, we do not wish to be limited to the details shown therein as obvious modifications may be made by one of ordinary skill in the art.

We claim:

1. In a fuze having air inlet means for allowing air flow to enter the fuze deflector means for deflecting a portion of said air flow away from said inlet.

2. A fuze as in claim 1, wherein said deflector means comprises a single deflecting element, and means to stationarily mount said element proximate said air inlet.

3. A fuze as in claim 2, wherein said deflecting element is located proximate the center of said inlet and deflects air in a radial direction with respect to the inlet.

4. A fuze as in claim 3 wherein a gap about the periphery of said deflector element permits direct entry of air flow into said fuze inlet means, and the path of air deflected by said deflector means intersects the path of air directly entering said inlet means.

5. A fuze as in claim 3, wherein said deflector element is convex at the center portion thereof, and comprises an annular trough about the periphery of said convex portion.

6. A fuze as in claim 5, wherein the outer-most peripheral wall portion of said trough deflects air in a generally forward direction with respect to the flight direction of said fuze.

7. A fuze as in claim 1, further comprising a power generating means in said fuze, said power generating means comprising a diaphragm means which is driven by air entering said inlet means and contacting said diaphragm means.

8. A fuze as in claim 7, wherein said diaphragm means is driven by air contacting a first portion thereof, and further comprising means to divert a portion of the air entering the fuze to a location proximate a second portion of said diaphragm means to balance forces applied to said diaphragm means.

9. A fuze as in claim 8, wherein said means to divert a portion of the air entering the fuze comprises vent means connecting regions on opposite sides of said diaphragm means.

* * * * *

UNITED STATES PATENT AND TRADEMARK OFFICE

CERTIFICATE OF CORRECTION

PATENT NO. : 4,362,106

DATED : December 7, 1982

INVENTOR(S) : Carl J. Campagnuolo and Henry C. Lee

It is certified that error appears in the above-identified patent and that said Letters Patent is hereby corrected as shown below:

Claim 1, line 2, after the word "fuze", insert --,--.

Signed and Sealed this

*Eighth* Day of *March 1983*

[SEAL]

*Attest:*

GERALD J. MOSSINGHOFF

*Attesting Officer*

*Commissioner of Patents and Trademarks*